US008764081B1

(12) United States Patent
Krieger

(10) Patent No.: US 8,764,081 B1
(45) Date of Patent: Jul. 1, 2014

(54) ZIPPER PULL ATTACHMENT

(71) Applicant: Westscot G. Krieger, Appleton, WI (US)

(72) Inventor: Westscot G. Krieger, Appleton, WI (US)

( * ) Notice: Subject to any disclaimer, the term of this patent is extended or adjusted under 35 U.S.C. 154(b) by 0 days.

(21) Appl. No.: 13/868,726

(22) Filed: Apr. 23, 2013

Related U.S. Application Data

(60) Provisional application No. 61/638,519, filed on Apr. 26, 2012.

(51) Int. Cl.
*A44B 19/00* (2006.01)

(52) U.S. Cl.
USPC ..... 294/3.6; 24/429

(58) Field of Classification Search
USPC ..... 294/3.6, 26, 137, 158; 24/429, 431
See application file for complete search history.

(56) References Cited

U.S. PATENT DOCUMENTS

| | | | | | |
|---|---|---|---|---|---|
| 1,640,102 | A | * | 8/1927 | Valliere | 294/26 |
| 3,017,680 | A | * | 1/1962 | Duncan | 294/3.6 |
| 3,522,964 | A | * | 8/1970 | Posavec | 294/3.6 |
| 3,583,044 | A | * | 6/1971 | Howell | 24/431 |
| 3,719,973 | A | * | 3/1973 | Bell | 24/429 |
| 4,243,164 | A | * | 1/1981 | Burlison et al. | 294/146 |
| 4,824,156 | A | * | 4/1989 | Greene | 294/142 |
| 4,918,794 | A | | 4/1990 | Harvey et al. | |
| 4,997,222 | A | | 3/1991 | Reed | |
| D320,367 | S | * | 10/1991 | Kalbach | D11/221 |
| 5,083,349 | A | * | 1/1992 | Axtell | 24/429 |
| 5,100,191 | A | | 3/1992 | Detrick et al. | |
| 5,930,874 | A | | 8/1999 | Yamazaki et al. | |
| 6,494,512 | B1 | | 12/2002 | Cada et al. | |
| 7,111,714 | B1 | | 9/2006 | Bell, III | |
| 2007/0157440 | A1 | * | 7/2007 | Malkin et al. | 24/429 |

OTHER PUBLICATIONS

Able Data, Zip-It Zipper Pull, Able Data Products webpage, May 25, 2010, 1page, www.abledata.com, U.S.

Able Data, Zip-It, Able Data Products webpage, Jun. 16, 2010, 1 page, www.abledata.com, U.S.

Goggle, Cross Zipper Pull, Google "zipper pull cross" search results, Mar. 8, 2012, 1 page, www.google.com, U.S.

Signal Centers, Zipper Pull (Full Instructions), webpage, Mar. 8, 2012, 2 pages, publisher unknown, U.S.

* cited by examiner

*Primary Examiner* — Dean Kramer
(74) *Attorney, Agent, or Firm* — Northern Michigan Patent Law, PLC

(57) ABSTRACT

A zipper pull attachment adapted to be clipped to a zipper pull tab and left in place to aid in opening and closing the zipper. The zipper pull attachment includes a vertical clip member, a ring member movably attached to the lower end of the clip member, and a fixed horizontal handle member secured horizontally through the ring member in the plane of the ring, with handle ends extending from the sides of the ring in balanced fashion.

12 Claims, 3 Drawing Sheets

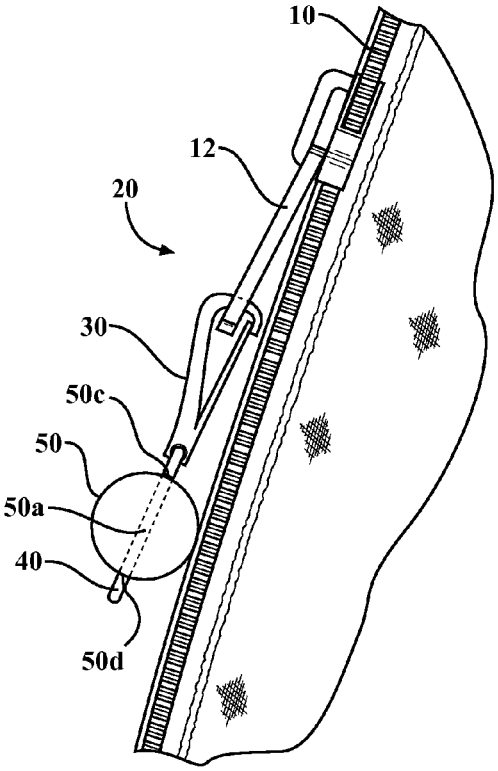
FIG. 4
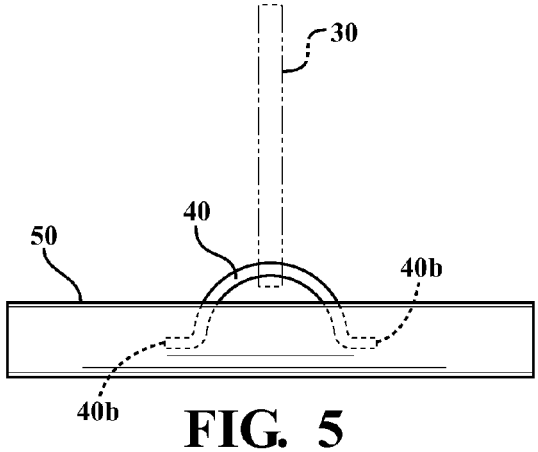
FIG. 5
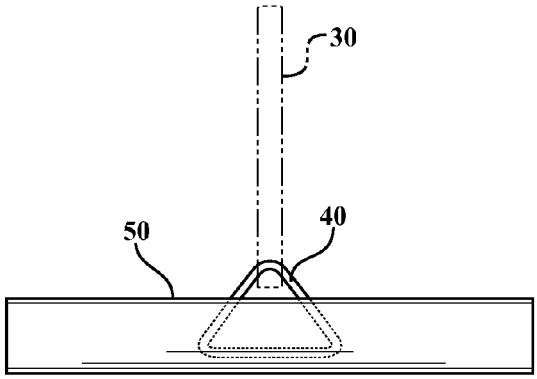
FIG. 6
FIG. 7
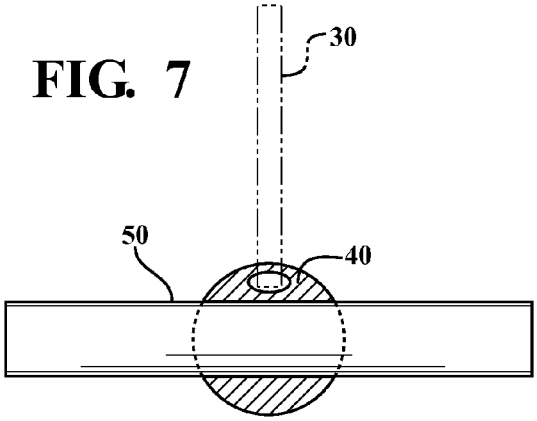
FIG. 8
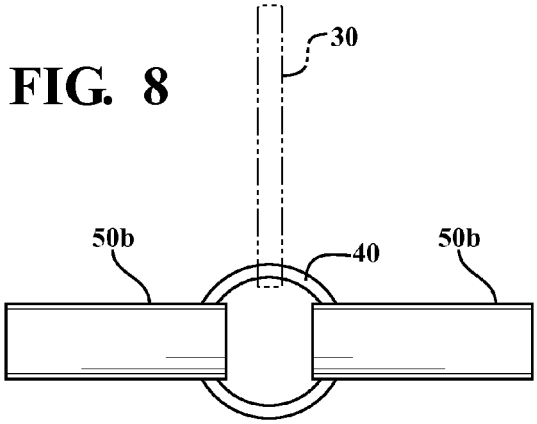

ZIPPER PULL ATTACHMENT

RELATED APPLICATIONS/PRIORITY BENEFIT CLAIM

This application claims the benefit of U.S. Provisional Application No. 61/638,519, filed Apr. 26, 2012 by the same inventor (Krieger), the entirety of which provisional application is hereby incorporated by reference.

FIELD

The subject matter of the present application is in the field of zipper pulls, and more specifically devices meant to be attached to an existing zipper pull tab to aid in opening and closing the zipper.

BACKGROUND

Zipper pull attachments use a grip-enhancing device more or less permanently secured to a zipper pull tab for regular use in operating the zipper. Patent examples include those shown in U.S. Pat. No. 4,918,794 to Harvey et al. (flexible elongated attachment for a zipper pull tab with the appearance of a miniature necktie); U.S. Pat. No. 5,930,874 to Yamazaki et al. (zipper pull with buckle type connector structure for attaching a fabric pull strap); and U.S. Pat. No. 7,111,714 to Bell, III (slide faster with a chord-type pull handle for hanging towels, shoes, etc., with one end of the handle connected to a zipper pull tab and the other end connected to the zippered article). Non-patent examples include pieces of cord or ribbon knotted through the zipper pull tab's opening; metal rings attached to the zipper pull tab with a spring hook or clip; and ornaments such as cross charms attached to the zipper pull tab with clips, chains, or swivel hooks.

Zipper pulling aids are also known, in which a separate handle with a hook at one end allows the user to reach and pull an otherwise difficult zipper by briefly hooking the opening in the pull tab. Patent examples include U.S. Pat. No. 4,997,222 to Reed (elongated zipper pulling device with a handle end, and a helical or spiral end adapted to be threaded through a zipper pull tab); U.S. Pat. No. 5,100,191 to Detrick et al. (zipper operating device shaped like a key so that it can be kept on a keychain when not in use); and U.S. Pat. No. 6,494,512 to Cada et al. (zipper pulling device with a jack-knife type handle and a hook member that pivots or folds into the handle). Non-patent examples include the "Zip It" zipper pull aid, with a t-shaped handle having a hook in one end adapted to reach and fit through a zipper pull tab opening, and an optional ring attachment that can be clipped to the zipper pull tab to make it easier to hook.

Prior attachment-type pulls are relatively small or weak and provide only moderate assistance with difficult zippers, and are often prone to twisting into odd positions that can make them more difficult to operate. The hook-equipped reach-and-pull devices are too cumbersome to carry, and are relatively awkward to use except when the user has time and privacy.

BRIEF SUMMARY

I have invented a zipper pull attachment adapted to be connected to a zipper pull tab, the attachment having a vertical clip member connectable at an upper end to a zipper pull tab so that it movably hangs from the tab generally parallel to the zipper; a generally flat, planar base member movably attached to a lower end of the clip in a plane adapted to be parallel to the zipper pull tab; and an elongated horizontal handle member connected horizontally through the base member in the plane of the base member, the ends of the handle member extending from each side of the base member. The handle member is fixed to the base member with no relative movement between them.

In a preferred form, the clip member is rigid and adapted to hang movably from the zipper pull tab, and connects to an opening in the pull tab. Also in a preferred form, the base member is a ring with a wire body, and may take both circular and non-circular shapes, such as semi-circular or triangular or square, without limitation. The base member is preferably connected to the lower end of the clip member in an articulated manner that allows vertical pivoting or rotation of the base member relative to the clip while limiting or resisting side-to-side twisting or rotation relative to the clip.

Further in the preferred form, the handle extends across or through the ring, connected to or intersecting the wire ring body at two points on opposite sides of the ring, with at least a portion of the ring extending above or below a corresponding upper or lower side of the handle to provide an attachment point for decorative or other items. The handle is preferably a single member extending across the ring, spanning the interior of the ring, or it may comprise two spaced handle portions with a common axis extending horizontally across or through the ring.

The base member may alternately be a solid, relatively flat planar disc or plate in the shape of a circle, triangle, square, etc., with a suitable connection to the clip member to permit up-and-down pivoting movement of the base member relative to the clip while limiting or resisting side-to-side twisting relative to the clip. It is also possible to form the base member, whether in ring or disc form, as a unitary part of the handle member, for example by molding or casting the base and handle as a single piece of material.

Terms of relative orientation such as coplanar, horizontal, vertical, and perpendicular should be understood to mean substantially so, since variations in the relative positions of the clip, base, and handle relative to one another and/or relative to a zipper may occur during assembly or manufacture or use.

These and other features and advantages of the invention will become apparent from the detailed description below, in light of the accompanying drawings.

BRIEF DESCRIPTION OF THE DRAWINGS

FIG. 4 is a side elevation view of the zipper pull attachment of FIG. 1, attached to the zipper.

FIGS. 5 through 8 are front elevation views similar to FIG. 1, but showing modified versions of the ring and/or handle.

DETAILED DESCRIPTION

Figure 1:
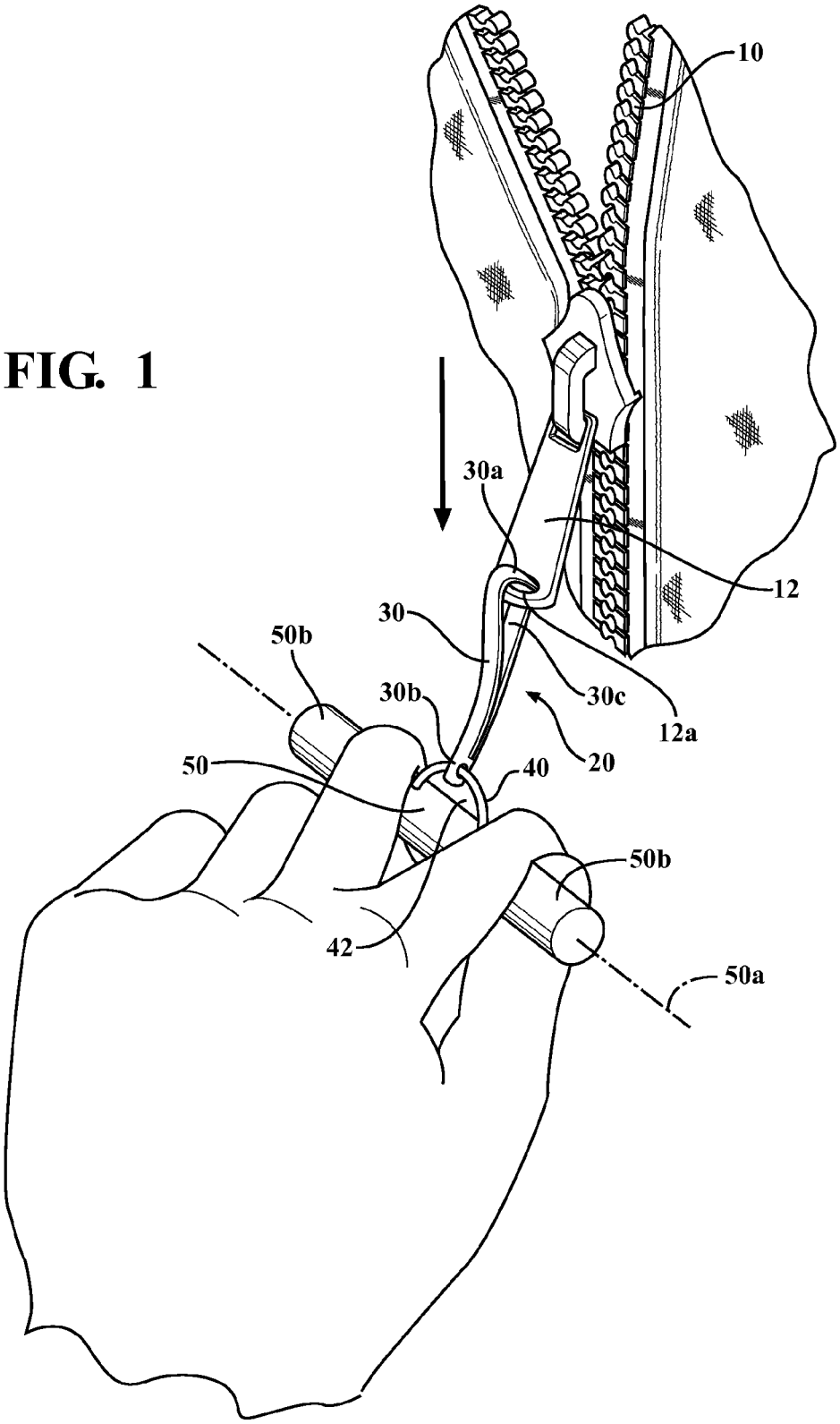
FIG. 1 is a front perspective view of a zipper pull attachment according to a currently preferred embodiment of the invention, attached to a zipper pull tab, with an arrow denoting downward pulling motion to open the zipper.
Figure 2:
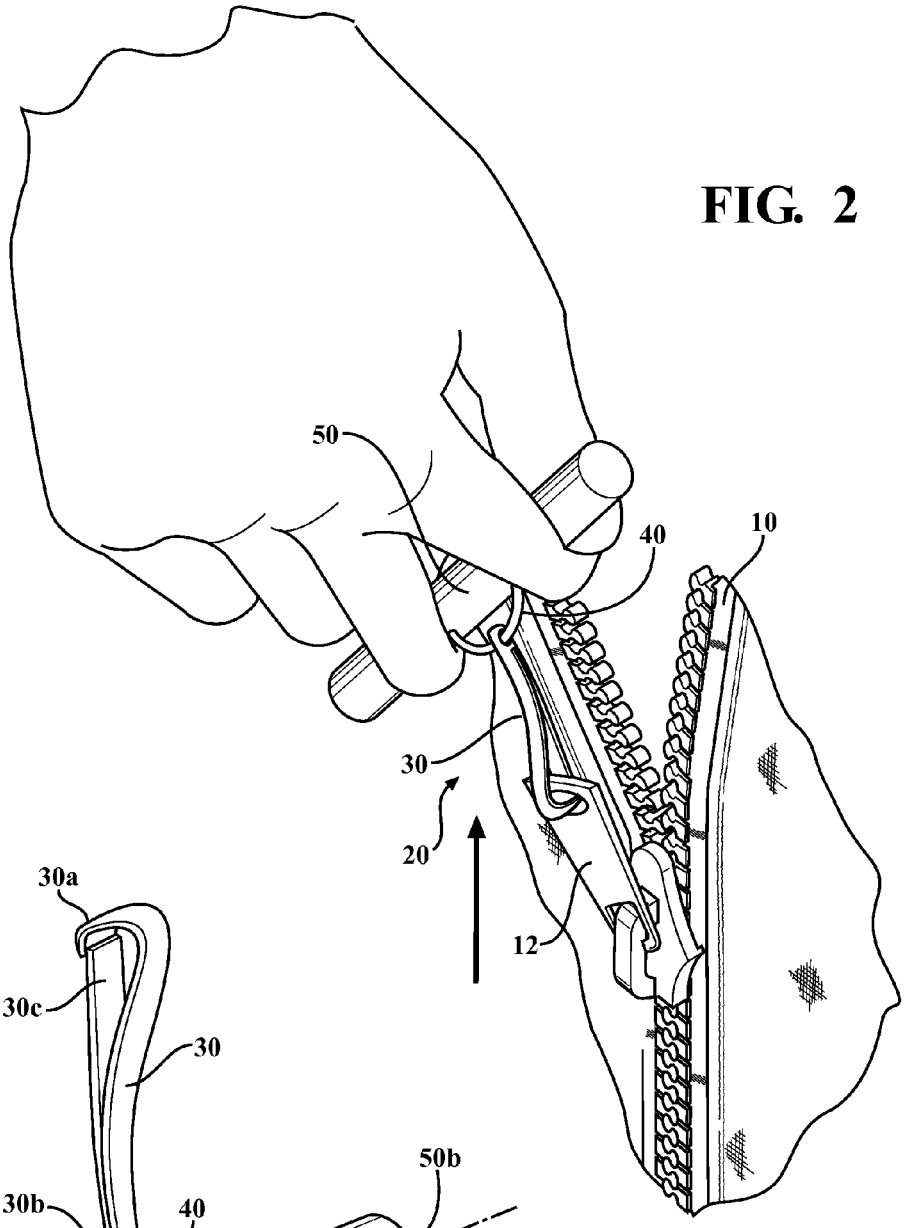
FIG. 2 is similar to FIG. 1, but with an arrow denoting upward pulling motion to close the zipper.
Figure 3:
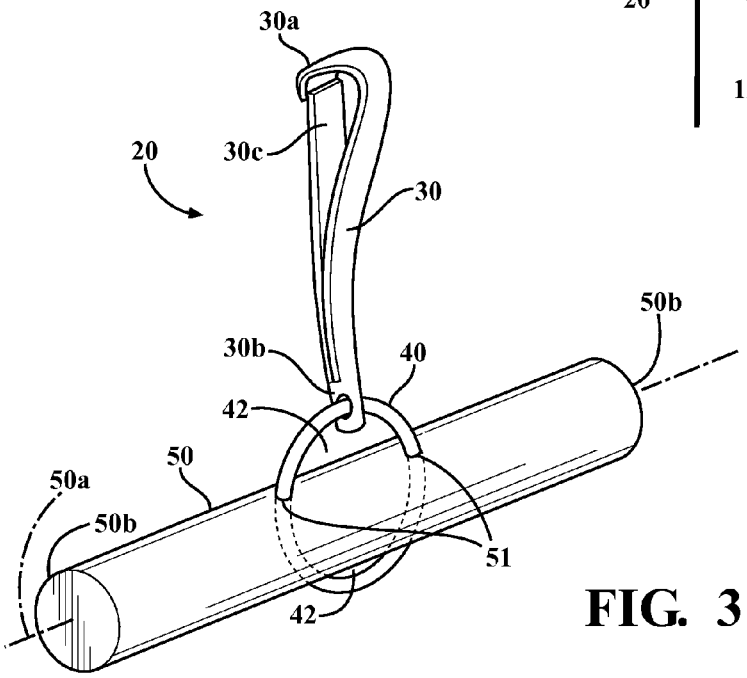
FIG. 3 is a front perspective view of the zipper pull attachment of FIG. 1, detached from the zipper pull tab.

Referring first to FIGS. 1 and 2, a zipper pull attachment 20 is shown in an exemplary and currently preferred form in order to teach how to make and use the claimed invention.

Attachment 20 includes a spring hook or clip member 30 of known, commercially available type, which will be referred to generally as a "clip" or "clip member". Illustrated clip 30 comprises an upper hook end 30*a*, a lower bight end 30*b*, and an optional spring locking arm 30*c*. Clip 30 may take other forms than the one illustrated, including but not limited to an open hook or a detent-type latching hook, provided that it hangs vertically when attached to a zipper pull tab 12 on a zipper 10 and lays fairly flat against the zipper. The body of the type of clip illustrated at 30 is generally made from metal having a flat cross-section, and so while the illustrated example is free to pivot or rotate up and down relative to the zipper pull tab, it will naturally resist side-to-side rotation (rotation about a vertical axis, hereafter "twisting") once clipped to the zipper pull tab 12. Clip 30 may also be formed from materials other than metal.

It is also possible to use a rotating or swiveling hook, chain, or similar connector for clip member 30, since other portions of attachment device 20 are also designed to limit or resist twisting, but a non-twisting clip 30 is currently preferred. It is also preferred that clip 30 be a rigid member, again to limit unnecessary twisting and movement of attachment device 20 from its preferred at-rest position lying essentially flat against the zipper.

Attachment device 20 also includes a planar base member 40 connected to the lower end 30*b* of clip 30. In the illustrated example, base member 40 is a relatively stiff metal wire ring of a type often used for attaching keys to keychains, although the material and cross-sectional shape of the ring may vary, and hangs movably from the lower end of the clip. Ring 40 is a true ring in that it has a circular wire body defining or enclosing a central open area 42. Ring 40 is essentially planar, taking into account the thickness of the wire body, and is attached to the lower end of clip 30 to extend or hang in a plane generally aligned with the clip so that the ring is able to lie substantially flat against a zipper when attachment device 20 is attached to a zipper pull tab 12.

Ring 40 may take other shapes than circular, as shown for example in FIGS. 5 and 6. Ring 40 may also be a substantially solid flat piece, for example a disc or plate member, as shown in FIG. 7.

Attachment device 20 further includes a horizontal handle member 50 secured to and extending horizontally through ring 40 in the plane of the ring, with ends protruding from both sides of the ring. By "through" the ring I mean that the horizontal axis of the handle is generally parallel to and extends across the ring, either immediately adjacent or actually intersecting the body/plane of the ring, and that the ends of the handle extend beyond the sides of the ring.

Illustrated handle 50 is a cylindrical dowel made from wood, plastic, or metal, although other elongated shapes and cross-sections are possible provided the handle can be attached to ring 40 with ends 50*b* extending horizontally from both sides of the ring, with the axis 50*a* of the handle 50 generally parallel to and preferably in the plane of ring 40, and with a comfortable grip for the fingers. Handle 50 should be centered on ring 40 for balance, with handle ends 50*b* extending equal distances from each side of the ring.

Handle 50 preferably extends through the plane of the ring, intersecting the ring's wire body on both sides. It would be possible to offset the axis of handle 50 from the plane of ring 40, but the offset is preferably minimal and the handle preferably remains parallel to the plane of ring 40. For example, handle 50 could be secured to ring 40 against the front or rear face of the ring at two points and still be considered substantially coplanar with the ring.

Handle 50 accordingly forms a horizontal handle relative to the vertical hanging direction of clip 30 and ring 40, giving the attachment device 20 an overall T-shape.

Handle 50 can be secured to ring 40 in various ways, including but not limited to molding a plastic handle material around ring 40, or by forming slots or holes for the ring body to be secured in and/or through the handle material, or by using a split or partial ring member with free ends 40*b* (FIG. 5) secured in the material of handle 50 mechanically, adhesively, or by molding. It would also be possible to mold or cast handle 50 and ring 40 as an integral member from the same material, with ring 40 effectively being an extension of the handle material. As noted above, it would also be possible to connect handle 50 to the front or rear side of ring 40.

As shown in the illustrated example, handle 50 evenly bisects ring 40 at its horizontal midpoint, and the thickness or diameter of handle 50 is less than the diameter of ring 40, such that portions of the ring extend above and below the upper and lower sides 50*c* and 50*d* of the handle (FIG. 4), with free space 42 between the ring body and the handle above and below the handle. It would be possible to have handle 50 extend through and intersect the sides of the ring above or below the midpoint of the ring, for example as shown in FIG. 6, with unequal portions of the ring extending above and/or below the handle's upper and lower sides.

Handle 50 is secured to the ring 40 at two points 51 on opposite sides of the ring so that the handle cannot rotate or otherwise shift relative to ring 40. The elongated horizontal shape of handle 50, with a length or end-to-end span greater than the diameter of ring 40, coupled with the generally flat, planar nature of ring 40, helps keep the handle lying flat against zipper 10 for ease of use, comfort, and appearance.

While handle 50 is illustrated as a single continuous member, it is also possible to form handle 50 as a two spaced members extending from either side of ring 40. For example, as shown in FIG. 8, handle ends 50*b* could be horizontally spaced members extending from each side of the ring 40 and having a common axis 50*a* running through the ring.

Description of Operation

In operation, the attachment device 20 is used by clipping the upper end of clip 30 through an opening 12*a* in a zipper pull tab 12 on the zipper 10 of a zippered item such as a boot or jacket. The attachment device 20 is primarily intended for use on worn clothing, where it remains and hangs from the zipper pull tab in a substantially downward vertical direction.

As shown in solid lines in FIG. 1, handle 50 can be grasped and pulled downwardly to open zipper 10, or can be grasped and pulled upwardly to close zipper 10.

Due to its fixed attachment to ring 40, handle 50 remains in a horizontal orientation relative to zipper 10 so that it is easy to locate and grasp, even when visibility is obscured by clothing or a part of the body, and remains horizontal when pulled to operate the zipper to apply maximum opening and closing force to the zipper. Handle 50 greatly increases the zipper's ease of use for those with large fingers, or in wet or cold conditions when gloves are worn, or for those with arthritis or other disabilities of the hand, or for situations where the zipper is at a person's maximum reach, for example when fastening or unfastening a zipper on a boot or shoe.

It will finally be understood that the disclosed embodiments represent presently preferred examples of how to make and use the invention, but are intended to enable rather than limit the invention. Variations and modifications of the illustrated examples in the foregoing written specification and drawings may be possible without departing from the scope of the invention. It should further be understood that to the extent the term "invention" is used in the written specification, it is not to be construed as a limiting term as to number of claimed or disclosed inventions or discoveries or the scope of any such invention or discovery, but as a term which has long been conveniently and widely used to describe new and useful improvements in science and the useful arts. The scope of the invention supported by the above disclosure should accordingly be construed within the scope of what it teaches and suggests to those skilled in the art, and within the scope of any claims that the above disclosure supports in this application or in any other application claiming priority to this application.

What is claimed:

1. A zipper pull attachment apparatus, comprising:

a vertical clip member having an upper end adapted to be attached to a zipper pull tab and configured to movably hang from the zipper pull tab generally parallel to the zipper;

a rigid, generally planar base member movably attached to a lower end of the vertical clip member and having a horizontal width wider than the vertical clip member, the base member defining a plane and having a vertical height; and, an elongated rigid horizontal handle secured to and extending horizontally through the base member substantially perpendicular to the vertical clip member, the horizontal handle being fixed relative to the base member, the horizontal handle further being substantially coplanar with the plane of the base member, the horizontal handle including first and second grip ends extending from respective sides of the base member in substantially balanced fashion; wherein, each of the first and second grip ends extends from its respective side of the base member a distance greater than the width of the base member and greater than the height of the base member.

2. The zipper pull attachment apparatus of claim 1, wherein the base member comprises a ring member intersected by the handle at at least two points on opposite sides of the ring member.

3. The zipper pull attachment apparatus of claim 2, wherein a portion of the ring member extends above or below a corresponding upper or lower side of the handle to provide an attachment point for other items.

4. The zipper pull attachment apparatus of claim 2, wherein the handle comprises a continuous member extending through the plane of the ring member and intersecting the ring member on opposite sides of the ring member.

5. The zipper pull attachment apparatus of claim 2, wherein the handle comprises two spaced grip members extending from the ring member on opposite sides of the ring member.

6. The zipper pull attachment apparatus of claim 1, wherein the vertical clip member upper end is configured to pivot or rotate up and down relative to a zipper pull tab when connected to a zipper pull tab.

7. In combination with a zipper having a zipper pull tab, a zipper pull attachment apparatus, comprising:

a vertical clip member having an upper end attached to the zipper pull tab so as to movably hang from the zipper pull tab generally parallel to and against the zipper;

a rigid generally planar base member movably attached to a lower end of the vertical clip member and having a horizontal width wider than the vertical clip member, the base member defining a plane and having a vertical height; and, an elongated rigid horizontal handle member secured to and extending horizontally through the base member substantially perpendicular to the vertical clip member, the horizontal handle member being fixed relative to the base member, the horizontal handle member further being substantially coplanar with the plane of the base member, the horizontal handle member having first and second grip ends extending from respective sides of the base member in balanced fashion; wherein, each of the first and second grip ends extends from its respective side of the base member a distance greater than the width of the base member and greater than the height of the base member.

8. The combination of claim 7, wherein the base member comprises a ring member intersected by the horizontal handle member at at least two points on opposite sides of the ring member.

9. The combination of claim 8, wherein a portion of the ring member extends above or below a corresponding upper or lower side of the horizontal handle member to provide an attachment point for other items.

10. The combination of claim 8, wherein the horizontal handle member comprises a continuous member extending through the plane of the ring member and intersecting the ring member on opposite sides of the ring member.

11. The combination of claim 8, wherein the horizontal handle member comprises two spaced grip members extending from the ring member on opposite sides of the ring member.

12. The combination of claim 7, wherein the vertical clip member upper end is free to pivot or rotate up and down relative to the zipper pull tab.

* * * * *